US011384904B2

(12) United States Patent
Kermaidic et al.

(10) Patent No.: US 11,384,904 B2
(45) Date of Patent: Jul. 12, 2022

(54) METHOD AND SYSTEM FOR FILLING THERMALLY INSULATED CONTAINERS WITH LIQUID CARBON DIOXIDE

(71) Applicant: Praxair Technology, Inc., Danbury, CT (US)

(72) Inventors: Jérôme Kermaidic, Vulaines sur Seine (FR); Nathalie Brixy, Munich (DE); Ranko Bursac, Libertyville, IL (US); Robert R. Sever, Northbrook, IL (US); Ying Zhou, Naperville, IL (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 335 days.

(21) Appl. No.: 16/410,027

(22) Filed: May 13, 2019

(65) Prior Publication Data

US 2019/0264872 A1 Aug. 29, 2019

Related U.S. Application Data

(63) Continuation-in-part of application No. 15/107,650, filed as application No. PCT/EP2014/076766 on Dec. 5, 2014, now Pat. No. 10,330,260.

(30) Foreign Application Priority Data

Dec. 5, 2013 (EP) ..... 13195836

(51) Int. Cl.
*F17C 13/02* (2006.01)
*F17C 13/00* (2006.01)
*F17C 5/02* (2006.01)

(52) U.S. Cl.
CPC ..... *F17C 13/003* (2013.01); *F17C 5/02* (2013.01); *F17C 13/023* (2013.01);
(Continued)

(58) Field of Classification Search
CPC ..... F17C 2221/013; F17C 2205/058; F17C 2250/0421; F17C 5/02; F17C 13/003
See application file for complete search history.

(56) References Cited

U.S. PATENT DOCUMENTS 1,770,944 A 7/1930 Payson
3,063,258 A ‡ 11/1962 Szachnitowski ..... F25D 3/125 62/309

(Continued)

FOREIGN PATENT DOCUMENTS

DE 101 29 217 1/2003
DE 10129217 1/2003

(Continued)

OTHER PUBLICATIONS

International Search Report dated Apr. 2, 2015 in International (PCT) Application No. PCT/EP2014/076766.

(Continued)

*Primary Examiner* — Matthew W Jellett
*Assistant Examiner* — Christopher D Ballman
(74) *Attorney, Agent, or Firm* — Wenderoth, Lind & Ponack, L.L.P.

(57) ABSTRACT

A method, and a system, are for filling a container with an amount of liquid carbon dioxide ($CO_2$) which is partially converted into an amount of solid $CO_2$ into the container, for maintaining one or more products, loaded into the container, at a defined temperature, below a defined temperature, or within a defined temperature range, the defined temperature or the defined temperature range being below environmental temperature. A method and a system are for providing identification and traceability data determining the container and the one or more products, and for enabling identification of the container during transport to a destination.

11 Claims, 2 Drawing Sheets

(52) U.S. Cl.
CPC ..... *F17C 13/025* (2013.01); *F17C 2205/054* (2013.01); *F17C 2205/058* (2013.01); *F17C 2221/013* (2013.01); *F17C 2250/0421* (2013.01)

(56) References Cited

U.S. PATENT DOCUMENTS

| | | | | |
|---|---|---|---|---|
| 3,464,509 | A ‡ | 9/1969 | Gray | G01G 5/003 177/208 |
| 3,667,242 | A | 6/1972 | Kilburn | |
| 3,810,365 | A * | 5/1974 | Hampton | F17C 5/00 62/54.1 |
| 4,127,008 | A ‡ | 11/1978 | Tyree, Jr. | |
| 4,206,616 | A | 6/1980 | Frank et al. | |
| 4,211,085 | A ‡ | 7/1980 | Tyree, Jr. | |
| 4,765,143 | A * | 8/1988 | Crawford | F01K 3/00 60/651 |
| 4,821,914 | A | 4/1989 | Owen et al. | |
| 4,883,099 | A * | 11/1989 | Vanommeren | F17C 5/02 141/1 |
| 4,887,857 | A * | 12/1989 | VanOmmeren | F17C 5/02 141/1 |
| 4,916,922 | A | 4/1990 | Mullens | |
| 5,511,379 | A | 4/1996 | Gibot et al. | |
| 5,548,974 | A | 8/1996 | Rhoades | |
| 5,993,165 | A | 11/1999 | Lorimer et al. | |
| 6,044,650 | A | 4/2000 | Cook et al. | |
| 6,119,465 | A | 9/2000 | Mullens et al. | |
| 6,209,341 | B1 | 4/2001 | Benedetti et al. | |
| 6,209,343 | B1 | 4/2001 | Owen | |
| 6,260,361 | B1 ‡ | 7/2001 | Tyree, Jr. | F17C 7/00 62/54.1 |
| 6,367,264 | B1 * | 4/2002 | Tyree, Jr. | F17C 5/02 62/47.1 |
| 6,467,642 | B2 | 10/2002 | Mullens et al. | |
| 6,584,802 | B1 | 7/2003 | Cofield et al. | |
| 7,226,552 | B2 | 6/2007 | Manini et al. | |
| 7,275,395 | B1 | 10/2007 | Ventura | |
| 7,310,967 | B2 | 12/2007 | Aragon | |
| 7,891,197 | B2 * | 2/2011 | Winter | F17C 5/02 62/50.1 |
| 8,820,098 | B2 * | 9/2014 | Zurecki | C21D 1/613 62/62 |
| 2006/0045754 | A1 | 3/2006 | Lukens | |
| 2006/0221877 | A1 * | 10/2006 | Belanger | G01N 29/46 370/310 |
| 2007/0008152 | A1 * | 1/2007 | Parias | H04Q 9/00 340/573.1 |
| 2008/0083763 | A1 | 4/2008 | Nielsen | |
| 2010/0299278 | A1 | 11/2010 | Kriss et al. | |
| 2011/0140850 | A1 ‡ | 6/2011 | Wassel | F17C 13/021 340/8.1 |
| 2012/0323691 | A1 * | 12/2012 | McLaughlin | G07C 9/20 705/14.58 |
| 2014/0026434 | A1 * | 1/2014 | Sawada | F26B 5/06 34/284 |
| 2015/0012122 | A1 * | 1/2015 | Minvielle | G01N 33/02 700/90 |
| 2016/0260161 | A1 | 9/2016 | Atchley et al. | |
| 2018/0010839 | A1 ‡ | 1/2018 | Zhou | A01N 1/0257 |

FOREIGN PATENT DOCUMENTS

| | | |
|---|---|---|
| EP | 0 854 334 | 7/1998 |
| EP | 0854334 | 7/1998 |
| EP | 3 032 195 | 6/2016 |
| EP | 3032195 | 6/2016 |
| FR | 2 765 366 | ‡ 12/1998 |
| GB | 763345 | ‡ 12/1956 |
| GB | 2 030 277 | 4/1980 |
| GB | 2030277 | 4/1980 |
| JP | 3029950 | 4/2000 |
| WO | 99/00755 | 1/1999 |
| WO | 2013/002426 | 1/2013 |
| WO | WO-2013/002426 | ‡ 1/2013 |
| WO | 2014/006281 | 1/2014 |
| WO | 2015/082704 | 6/2015 |

OTHER PUBLICATIONS

Written Opinion of the International Searching Authority dated Apr. 2, 2016 in International (PCT) Application No. PCT/EP2014/076766.

* cited by examiner
‡ imported from a related application

METHOD AND SYSTEM FOR FILLING THERMALLY INSULATED CONTAINERS WITH LIQUID CARBON DIOXIDE

RELATED APPLICATIONS

This application is a continuation-in-part of U.S. application Ser. No. 15/107,650 filed on Jun. 23, 2016, which claims the benefit of priority to International Application PCT/EP2014/076766 with an international filing date of Dec. 5, 2014, which claims the benefit of priority to European Patent Application No. 13195836 with a filing date of Dec. 5, 2013, the disclosures of which is each hereby incorporated by reference in their respective entireties, for all purposes.

FIELD OF THE INVENTION

The present invention relates to a method, as well as a system, for filling a container with an amount of liquid carbon dioxide ($CO_2$) which is partially converted into an amount of solid $CO_2$ into said container, for the purpose of maintaining one or more products, loaded into said container, at a defined temperature, below a defined temperature, or within a defined temperature range, which temperature or temperature range is below environmental temperature. The invention further relates to a method and a system for providing identification and traceability data determining the container and its loaded one or more products, and for enabling the identification of said container during transport to a particular destination.

BACKGROUND

In the field of maintaining goods at a defined temperature which is below environmental temperature, in particular for maintaining goods so as to be cold or frozen, especially during transport, several different solutions have been proposed in the prior art. Some of these comprise the use of vehicles with integrated freezers or refrigerators. Other solutions are based on the use of thermally insulated containers, supplied with solid $CO_2$, as is the case in the present invention.

EP1326046 B1 (Yara International ASA) discloses a multi-coupling system for filling containers, in particular thermally insulated containers, to be supplied with a cryogenic medium such as solid $CO_2$ (commonly known as dry ice), with liquid $CO_2$, injected from a liquid source, and which is converted into solid $CO_2$ upon injection. Typically, a specifically dedicated inner part of such thermally insulated containers comprises a compartment or cell that is dedicated to containing the cryogenic medium, e.g., solid $CO_2$, by separating it from the product transported inside the thermally insulated container.

The amount of solid $CO_2$ to be supplied to a container is typically calculated based on the required residence time of the loaded one or more products to be maintained at a defined temperature, below a defined temperature, or within a defined temperature range, which temperature or temperature range is below environmental temperature. Consequently, the residence time is the time the one or more loaded products are to be maintained in the container at a defined temperature, below a defined temperature, or within a defined temperature range, which temperature or temperature range is below environmental temperature, e.g., during transport of the container. Typical residence times are 12 hours up to 3 days (i.e., over a weekend, from a Friday morning until a Monday morning), or even longer.

When performing the filling of the container with $CO_2$, in the prior art, it is mentioned that the amount of solid $CO_2$ to be generated is based on the duration of the injection of the liquid $CO_2$. This is a fairly inaccurate method. When the liquid $CO_2$, which is stored in a refrigerated form, expands into the cold cell located in the container, this cold cell being specially developed for this purpose, approximately 50-60% of the injected quantity becomes dry ice and approximately 40-50% becomes gaseous $CO_2$, depending on the pressure within this cold cell. The gaseous $CO_2$ produced on injection, i.e., 40-50% of the total injected quantity, is extracted via suitable devices in order to prevent an impermissible concentration of the $CO_2$ in the atmosphere of the working premises.

Therefore, the prior art method of determining the amount of solid $CO_2$ that is actually supplied to a container upon injection of liquid $CO_2$ will give rise to large uncertainties due to, for example, pressure and temperature variations during the filling operation.

As soon as the desired quantity of liquid $CO_2$ is injected into the cooling container, the $CO_2$ filling process is automatically stopped by a timer in control thereof.

Furthermore, the prior art method will not provide identification and traceability of relevant data for a container filled with $CO_2$.

Consequently, there exists the need to provide a more accurate way of supplying an amount of solid $CO_2$ to a thermally insulated container.

SUMMARY OF THE INVENTION

The present invention relates to a method for filling a compartment in an inner part of a container with an amount of liquid $CO_2$ which is partially converted into an amount of solid $CO_2$ upon injection of the liquid $CO_2$ into said compartment, said container being designed to contain one or more products loaded into it, wherein said products are to be maintained at a defined temperature, below a defined temperature, or within a defined temperature range, which temperature or temperature range is below environmental temperature, using said solid $CO_2$, wherein said container is subjected to a weighing operation using weighing means resulting into a weight of said container, wherein said weight of said container, is determined by said weighing means at least before and after said container has been supplied with said amount of converted solid $CO_2$.

Further, in another aspect there is provided a method for filling a container with an amount of liquid $CO_2$ which is partially converted into an amount of solid $CO_2$ in said container, for the purpose of maintaining one or more products, loaded into said container, at a defined temperature, below a defined temperature, or within a defined temperature range, which temperature or temperature range is below environmental temperature, wherein said container, optionally loaded with one or more products, is subjected to a weighing operation using weighing means resulting into a weight of said container, wherein said weight of said container, optionally loaded with one or more products, is determined by said weighing means at least before and after said container has been supplied with said amount of converted solid $CO_2$.

The inventive method according to the invention will contribute to increased accuracy of the determination of the amount of solid $CO_2$ supplied to the container, compared to prior art methods and systems. This leads to less $CO_2$ consumption, and hence to a lower carbon dioxide footprint.

Furthermore, because of a weighing operation, in case of an emergency situation like a power failure, the filling process does not need to be restarted as is the case in prior art systems, as the data on the amount of liquid $CO_2$ already filled before the power failure, is not lost.

According to one embodiment, the method comprises the following steps:

(a) determining the weight of said container, using weighing means;

(b) generating barcode data by scanning a barcode, provided with the container;

(c) calculating the weight of the amount of converted solid $CO_2$ to be supplied to said compartment in the inner part of said container, based on said barcode data, generated in step (b);

(d) filling said container with an amount of liquid $CO_2$, thereby monitoring the weight of the container, until the weight of the container is equal to the weight of the container, as determined in step (a), increased by the weight of the amount of converted solid $CO_2$, as calculated in step (c);

(e) storing in a database, the barcode data, obtained in step (b); and (f) storing in said database, data on the weight of the amount of converted solid $CO_2$, supplied to said container, as determined in step (c).

Particularly, the invention relates to a method for filling a container with an amount of liquid $CO_2$ which is partially converted into an amount of solid $CO_2$ in said container, for the purpose of maintaining one or more products, loaded into said container, at a defined temperature, below a defined temperature, or within a defined temperature range, which temperature or temperature range is below environmental temperature, comprising the following steps:

(a) determining the weight of a container, optionally loaded with one or more products, using weighing means, in particular by placing the container, optionally loaded with one or more products, on a weighbridge;

(b) generating barcode data by scanning a barcode, provided with the container, said barcode data describing, for example, the type of said container, the type of said loaded one or more products, the required residence time of the one or more products in said container and the destination of said container;

(c) calculating the weight of the amount of solid $CO_2$ to be supplied to the container, based on said barcode data, generated in step (b), in particular based on the required temperature of said container, the nature of said loaded one or more products and the required residence time of said loaded one or more products;

(d) filling said container with an amount of liquid $CO_2$, thereby monitoring the weight of the container, until the weight of the container is equal to the weight of the container, as determined in step (a), increased by the weight of the amount of solid $CO_2$, as calculated in step (c);

(e) storing in said database, said barcode data, obtained in step (b); and (f) storing in said database, data on the weight of the amount of solid $CO_2$ supplied to said container, as obtained in step (d).

This method will also provide identification and traceability data determining the container and its loaded one or more products that will enable the identification of said container during transport to a particular destination and that will enable reviewing its history and building statistical data for later review.

According to one embodiment, the container is a thermally insulated container.

According to one embodiment, the container may be empty or may already be loaded with one or more products, when subjecting the container to the method according to the invention.

According to one embodiment, data on the weight of the amount of solid $CO_2$, supplied to said container, comprise the weight of the amount of liquid $CO_2$, injected into said container, the weight of the amount of solid $CO_2$, and the date and time of the filling operation.

Furthermore, it should be noted that the order of the method steps, as recited above, may be executed in any order, as long as step (c) follows after step (b), step (d) follows after step (a) and step (c), step (e) follows after step (b), and step (f) follows after step (d). With the wording "follows after", it is meant that a step A is executed after a step B, either immediately after, or with one or more intervening step.

The invention is also related to a system for performing the inventive method as described above.

The invention concerns a system for filling a compartment in an inner part of a container with an amount of liquid $CO_2$, which is partially converted into an amount of solid $CO_2$ upon injection of the liquid $CO_2$ into said compartment, said container being designed to contain one or more products loaded into it, wherein said products are to be maintained at a defined temperature, below a defined temperature, or within a defined temperature range, which temperature or temperature range is below environmental temperature, using said solid $CO_2$, wherein said system comprises weighing means for subjecting said container to a weighing operation resulting into a weight of said container at least before and after said inner part of said container has been supplied with said amount of converted solid $CO_2$.

In one embodiment, the system comprises:

weighing means, capable of determining the weight of said container;

a barcode scanner, capable of scanning a barcode, provided with said container for generating barcode data;

calculating means, capable of calculating the weight of the amount of converted solid $CO_2$ to be supplied to said compartment in the inner part of the container, based on said barcode data; and filling means, capable of filling said compartment in the inner part of said container with an amount of liquid $CO_2$ which is at least partially converted into solid $CO_2$ upon injection of the liquid $CO_2$ into said compartment, thereby monitoring the weight of the container, until the weight of the container is equal to the weight of the container as previously determined, increased by the weight of the calculated amount of converted solid $CO_2$; and a database, capable of storing said barcode data, and data on the weight of the amount of converted solid $CO_2$, supplied to said compartment in the inner part of said container.

DETAILED DESCRIPTION OF THE INVENTION

The invention will now be described in detail with reference to the drawings. The detailed description contemplates the features, aspects and embodiments in various permutations and combinations, as being within the scope of the disclosure. The disclosure may therefore be specified as comprising, consisting of or consisting essentially of, any of such combinations and permutations of these specific features, aspects, and embodiments, or a selected one or ones thereof.

A particular purpose of the present invention is maintaining goods so as to be cold or frozen for a specific period of time. Goods to be kept cold or frozen can be different types of products like, for instance, food, pharmaceutical products and biological products. Such products will typically have an expiration date and must be kept at a specific low temperature prior to said expiration date. In order to comply with this requirement during loading from a facility, as well as shipping and transport to a destination, the products are stored in a compartment of a thermally insulated container 100, supplied with a specific amount of solid $CO_2$. According to the invention, the injected amount of liquid $CO_2$ is weighted in order to increase the accuracy of the determination of the amount of solid $CO_2$ and to avoid the disadvantages in the filling process, known from prior art systems. It should be understood that container 100 can mean any storage, filling, delivery or transportable vessel capable of receiving solid $CO_2$ or $CO_2$ fluid and capable of receiving one or more products, including but not limited to cylinders, dewars, bottles, tanks, barrels, bulk tanks and microbulk tanks.

Another purpose of the invention is enabling identification and traceability of a container 100 during transport to a destination, together with the amount of $CO_2$ filled.

Figure 1:
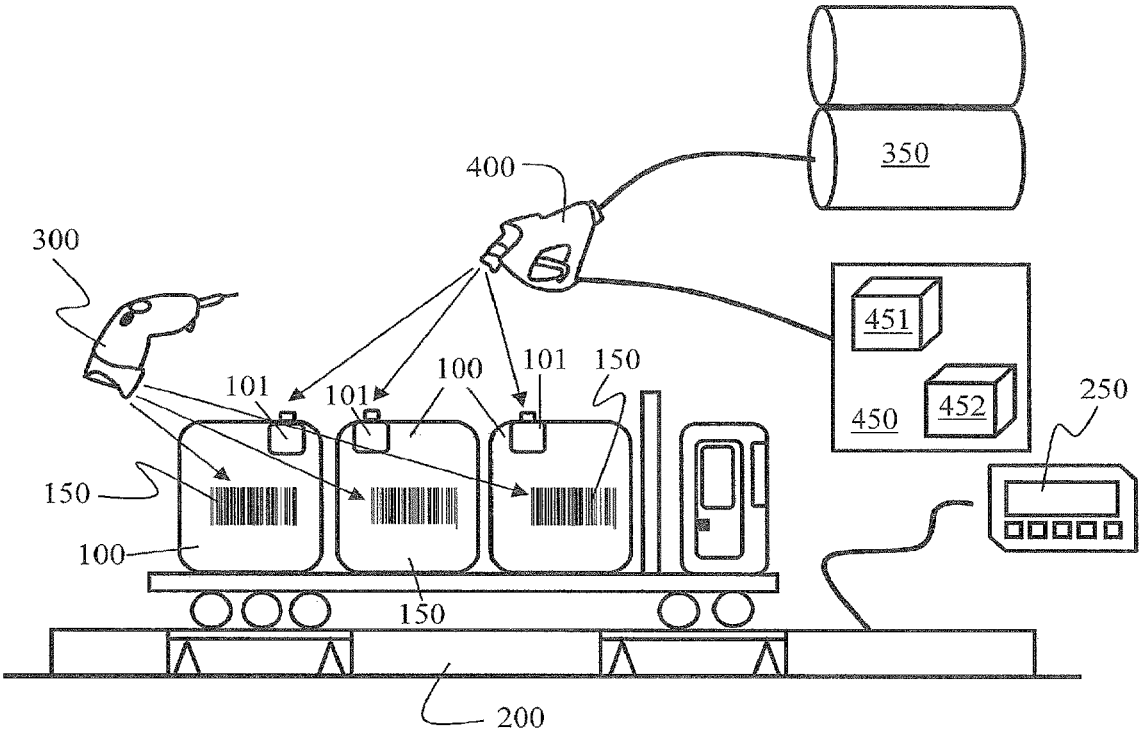
FIG. 1 shows an example of a setup used for performing the method according to the invention.

FIG. 1 shows an embodiment of a setup, used for performing the inventive method for filling a compartment 101 of a thermally insulated container 100 with a specific amount of $CO_2$ for the purpose of maintaining its content so as to be frozen or cold.

For performing the method, the system comprises a thermally insulated container 100 with an inner compartment 101 (in FIG. 1, several containers 100 are shown), a weighing scale 200 generating weighing data, weight display means 250 displaying said weighing data, a barcode scanner 300 for scanning a barcode 150 related to one or more containers 100 and generating barcode data, control means 450 comprising a database 451 for storing said barcode data and weighing data, as well as calculation means 452 for calculating the weight of the amount of solid $CO_2$ to be supplied, and a filling gun 400, connected to a supply of liquid $CO_2$ 350 for filling liquid $CO_2$ into each container 100. It should be understood that as used herein and throughout, a barcode is intended to include any type of barcode, including linear barcodes and two-dimensional barcodes, such as a QR code.

The weighing scale 200 is connected to the weight display means 250 which in turn is connected to the database 451. The connection can be wired or wireless by known means and protocols, e.g. Ethernet, WiFi, HTTPS, RS232, GSM, FTP, etc.

When filling a container with liquid $CO_2$, a filling gun 400, connected to a supply of liquid $CO_2$, is attached to the container 100. The filling gun 400 is connected to the control means 450 for controlling the amount of liquid $CO_2$ to be filled, based on calculated and measured weight of solid $CO_2$. The control means 450 is a computer controlling opening and closing of a valve in the filling gun 400. The amount of liquid $CO_2$ to be filled in each container 100 is thus based on the calculated weight of solid $CO_2$ to be supplied to the respective container 100 and measured weight of the container 100 that is being filled with liquid $CO_2$ that at least partially converts into solid $CO_2$ when in this container 100.

The functions and operations of the different devices comprised in the system will now be further described with reference to the inventive method.

The inventive method comprises several steps to be performed. The method is typically performed when an order is received regarding products to be transported from a storage or production facility to a specific destination, e.g., a store or a shop.

The first step in the method is embodied by placing a container 100 on a weighing scale 200. The number of containers 100 placed on the weighing scale 200 can range from 1 to 4, and will typically be 3 to 4 containers 100. Prior to placing a container 100 on the weighing scale 200, they may be loaded with goods or products.

In one embodiment, the type of weighing means 200 used is a weighbridge, as shown in FIG. 1. In another embodiment, the weighing means 200 is a wheel weight (not shown in the figures). In yet another embodiment, the weighing means is a suspended spring weight (not shown in the figures). The type of weighing means 200 used will depend on the specific requirement or setup at the loading facility.

Each container 100 to be shipped is provided with a barcode 150 describing at least the type of container 100, the type of loaded one or more products, the required residence time of the one or more products in said container, and the destination of the container 100.

The next step in the method is scanning each barcode 150 of the at least one thermally insulated container 100 by means of a barcode scanner 300 and thereby generating barcode data.

The generated barcode data is transferred and stored in a database 451. The barcode data is transferred to the database 451 via known means, i.e., via cable or wireless. In one embodiment of the invention, the database 451 is accessible through a dedicated secured interface, e.g., a secured Internet website.

The scanning of a barcode of a container 100 can be performed in the loading process of loading a container 100 onto the weighing scale 200 or after a container 100 has been loaded on the weighing scale 200 and the weight of the container 100 has been determined. Hence the steps of (a) determining the weight of a container 100, optionally loaded with one or more products, using weighing means 200; and (b) generating barcode data by scanning a barcode 150, provided with the container 100, are interchangeable and/or are interchanged.

The next step in the inventive method is calculating the amount of $CO_2$ to be filled in the container 100 based on the barcode data, for example, on the temperature to be maintained in each container 100 during the time of transportation to its destination, i.e. the loading time of the products.

The total amount of the liquid $CO_2$ to be filled is based on the total weight of solid $CO_2$ to be supplied to a container 100 for maintaining its content at a defined temperature, below a defined temperature, or within a defined temperature range, which temperature or temperature range is below environmental temperature during the whole transportation period.

In addition to the transportation time, another input parameter in the calculation of the amount of $CO_2$ is the environmental temperature of the surroundings where the container will be located during transport.

The thermodynamic principle used will now be explained, wherein:

| formula $Q = k * S * \Delta T * t * \alpha = m * L$ | | | |
|---|---|---|---|
| heat quantity | Q | | J |
| heat exchange overall coefficient | k | | W/m2 · K |
| surface | S | | m2 |
| temperature difference | $\Delta T = \theta ext - \theta int$ | | K |
| transport duration | t | | s |
| insulation thickness | e | | m |
| insulation thermal conductivity | λ | | W/m · K |
| CO2 values | | | |
| snow potential energy | L | 640 | kJ/kg |
| Safety coefficient | α | 1 | |
| | | to establish during test period | |

The amount of energy Q, defined as heat quantity, is calculated in order to determine the amount of $CO_2$, necessary to compensate for this amount of energy Q, lost through the walls of a given thermally insulated container 100 during a given time, and for a given temperature difference. The amount of $CO_2$ allows a container 100 to maintain its internal temperature at a defined temperature, below a defined temperature, or within a defined temperature range.

Heat exchange overall coefficient k is a technical data given by the manufacturer of the container 100. It depends on the insulation product used (e.g., polystyrene, polyurethane, etc.). Heat exchange overall coefficient k is linked to insulation thickness and component thermal conductivity.

Surface S is the total internal surface of the thermally insulated container ($m^2$), exposed to the environmental temperature.

ΔT is the difference between the environmental temperature $\theta_{ext}$ and the internal temperature $\theta_{int}$. The internal temperature $\theta_{int}$ is determined by the products to be transported. Most of these product storage temperatures are determined according to established European or local directives, regulations or best practices. The environmental temperature $\theta_{ext}$ is determined by an operator each day or can be determined by a weather station, located at the site of the operator, e.g., NETATMO weather station. Hence, according to one embodiment, the environmental temperature can be based on a temperature measurement or can be any temperature value, determined by an operator. It is worth noting that solid $CO_2$ (dry ice) has a temperature of −109.3° F. (−78.5° C.) at 1 atmosphere. Hence, the internal temperature can never be set lower than said temperature.

The environmental temperature can be modified by an operator with an "adjustment factor" representing a percentage between early morning and afternoon seasonal average variation. Usually, containers 100 for holding goods are prepared early in the morning and are transported within the following day, depending on the distance between the preparation area and the delivery point. The environmental temperature will typically be higher in the middle of the afternoon. Said "adjustment factor" will thus add a standard percentage to the early morning environmental temperature. For instance, if the environmental temperature early in the morning is 22° C., an adjustment factor of +30% means that the maximal environmental temperature of the day will be around 28.6° C. Using the system of FIG. 3, an operator can also use + or − signs (see FIG. 3) to increase or decrease the adjustment factor with his weather knowledge.

Hence, in one embodiment of the method according to the invention, the environmental temperature is based on a temperature measurement, adjusted with an adjustment factor.

In yet another embodiment, the environmental temperature used for calculation is manually set, for example, by an operator. A scenario where this is relevant is when the difference between the selected environmental temperature and the measured environmental temperature is too high, i.e., greater than a set level. The set level may, for instance, be 5° C. If this is the case, an alarm will be triggered, or notification will be given via the control screen (see FIG. 3). An operator can then manually change the value of the temperature to be used in the calculation of the amount of $CO_2$.

Time t is determined by a guarantee of a total transport time (for instance, 48 hours) or a guarantee until an arrival time (for example, the products are prepared on day A and, for instance, delivery is planned to be made on day B at 13:00).

Usually, a safety coefficient α is further added to adjust the thermodynamic formula to take into account, for instance, the aging of the thermally insulated containers. This safety coefficient is adapted on a container-by-container basis, for instance, based on the operators' knowledge and/or the results of a quality campaign.

When the temperature to be used in the calculation is determined, the calculation of the amount of $CO_2$ based on the weight of the container 100, optionally loaded with one or more products, will be done. The calculation itself is based on a well-known thermodynamic calculation and further details will not be described here.

After the amount of the solid $CO_2$, to be supplied to a container 100, has been calculated, the next step in the method is filling said container 100 with an amount of liquid $CO_2$, thereby monitoring the weight of the container, optionally loaded with one or more products, until the weight of the container 100 is equal to the weight of the container 100, as determined by weighing using said weighing means 200, increased by the weight of the calculated amount of solid $CO_2$. Filling will start once the filling gun 400 has been connected to a container 100 and will stop once the calculated weight of the $CO_2$ for that container 100 has been reached.

If the filling fails due to, for instance, an emergency stop, e.g. a filling gun 400 off hook signal or a too high level of $CO_2$ in the area, the system will remember the last weight value and an operator can restart the filling process to reach the calculated amount of solid $CO_2$, starting from said last weight value. This is a big advantage compared to filling methods known from the prior art in which filling will be halted.

Prior to filling each container 100, the weight can be reset. Hence, the weight of the container 100, optionally loaded with one or more products, is monitored until the weight of the container 100 is equal to the weight of the container, as determined by weighing (but reset to zero), increased by the weight of the calculated amount of solid $CO_2$.

The weight of the amount of solid $CO_2$ supplied to a container 100, as well as the date and time of filling/weighing is registered into said database 451 together with its barcode data. The weight of each container 100 will then be traceable together with the other barcode data for each container 100.

Figure 2:
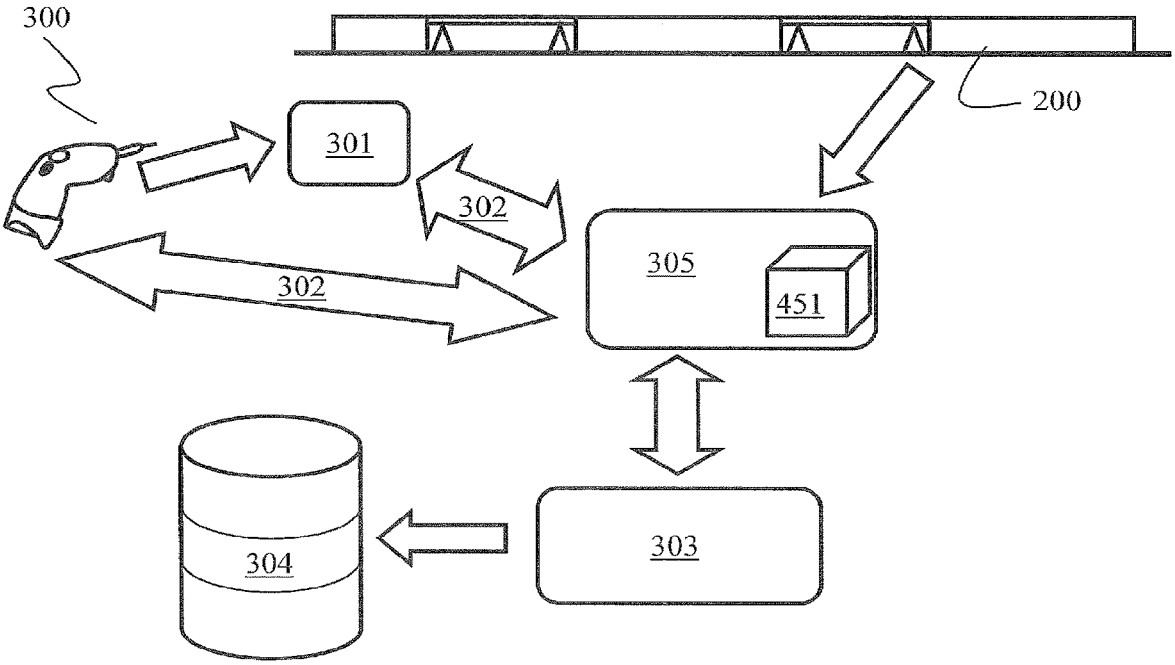
FIG. 2 shows an overview of the different components comprised in the system according to the invention for enabling registration of traceable data.

FIG. 2 shows an overview of the different components that may be comprised in the system for providing identification and traceability data, determining the container 100 and its loaded one or more products, and for enabling the identification of said container 100 during transport to a particular destination.

FIG. 2 illustrates the principle enabling full traceability for both the supplier and the customer of the loaded products. The main component in this set-up is the dosing system 305 where all relevant data regarding registered/scanned containers 100 are stored in a database 451.

The main inputs to the system comprising the database 451 are barcode data, generated by the barcode reader 300, and weight data, measured by the weighing scale 200. In one embodiment, the generated barcode data is transmitted from a barcode scanner 300 with a built-in wireless transmitter 301. In another embodiment, scanned data is sent from the barcode scanner 300 with wired means and interface 302, e.g. RS232.

All data 303 identifying a container 100, are traceable from an external server 304. Customers may log on to the database 451 for tracing relevant parameters for their containers 100 with ordered products.

Figure 3:
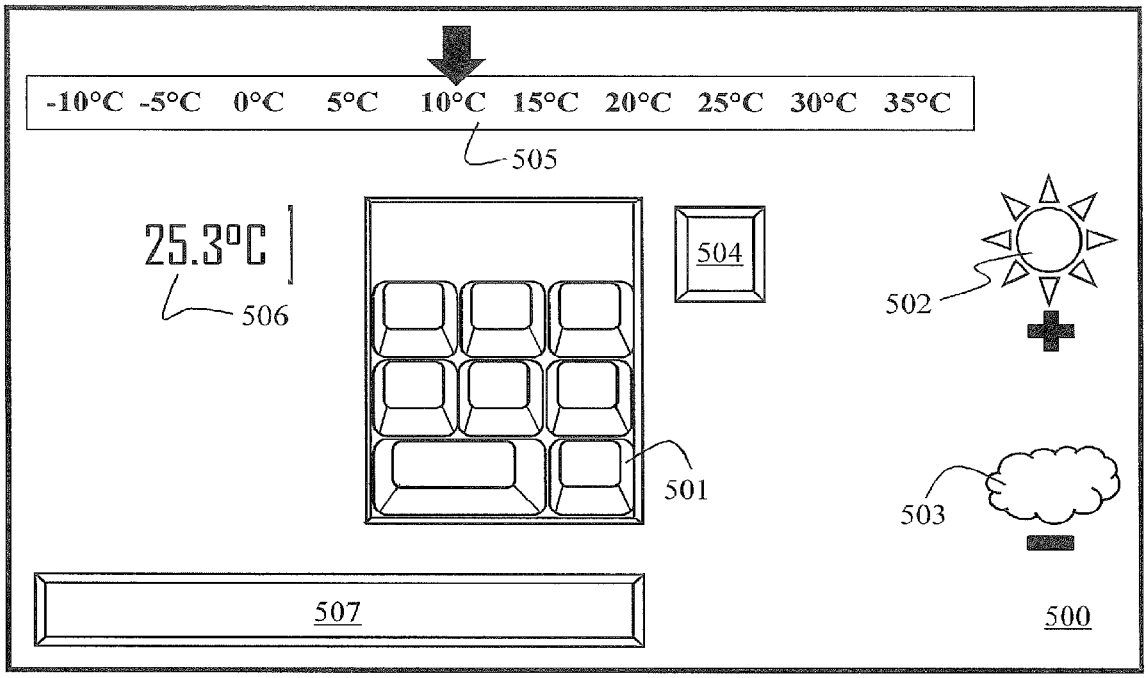
FIG. 3 shows an example of a control panel used for controlling the filling process according to the invention.

FIG. 3 shows an example of a control panel 500 used for controlling the system and the filling process. The panel is located at the loading facility of the thermally insulated containers 100.

As mentioned above, the system can be operated automatically, based on direct environmental temperature data (shown on display 506), or an operator can manually override the environmental temperature, used in the calculation of the amount of solid $CO_2$ to be supplied to each cabinet.

The type of container 100 used, the type of product transported, the desired temperature 505 inside the container 100, and the time period for maintaining a product so as to be frozen or cold, can be selected from different default programs 507. By inputting a code on a number pad 501, an operator can select such a specific program. The control panel can also be used for making tailor-made programs for specific needs.

By pressing the sun sign (502, right upper area), the temperature used in the calculations will increase, and by pressing the cloud sign (503, right upper area), the temperature will decrease. Relevant selected information will be displayed on a display panel 504.

The following describes an example of a typical user scenario when using the system and method according to the present invention. An operator of the system receives an order for a product and loads one or more containers 100 with the ordered product. This may, for instance, be frozen fish to be transported to a food shop at a distance with a travel time of 6 hours (the residence time is at least equal to the travel time). The specific food shop may or may not already be registered in the system, for example, after having placed a previous order. If it is already registered, returned containers 100 used in a previous shipment, are already provided with barcodes 150 identifying the products and the customer. If it is not registered, new barcodes 150 will be generated with relevant information. According to one embodiment, the barcode data comprises at least data such as the type of container 100, the type of loaded one or more products, the required residence time of the one or more products in said container 100, and the destination of the container 100. Furthermore, it may contain data identifying the customer.

The type of container 100 used, the time to maintaining a product so as to be frozen (residence time of the one or more products), and the environmental temperature will directly influence the amount of solid $CO_2$ to be supplied to the container 100 and hence, the amount of liquid $CO_2$ to be injected into the container 100.

Each container 100 with the frozen fish is subsequently loaded onto a weighbridge 200. This operation is typically performed by means of an order picker forklift placing 3 to 4 containers 100 on the weighbridge 200. The frozen fish may also be loaded into the containers 100 after the containers 100 have been loaded onto the weighbridge 200.

The barcodes 150 on the containers 100 are scanned and the barcode data is registered in the database 451 providing online access for the customer. Based on the barcode data and the selected environmental temperature (either determined by measurement or manually set), the amount of solid $CO_2$ to be supplied to each container 100 is calculated. The weighbridge 200 may be reset before filling each container 100 such that only the weight of the solid $CO_2$ is shown.

An operator or a robot will then connect the filling gun 400 to the container 100 to be filled, and filling is performed while the amount of solid $CO_2$ is measured. When the calculated amount of $CO_2$ has been reached, as determined from the weighing operation, the control means 450 controlling the filling gun 400 will stop the filling and the actual weight of solid $CO_2$ will be registered in the database 451 together with the date and the time of filling and the relevant barcode data for the filled container 100. The same injection operation will be performed on the next container 100 until all containers 100 on the weighbridge 200 are filled.

The invention further relates to the system for performing the method as disclosed above. Furthermore, the invention relates to a system for filling a container 100 with an amount of $CO_2$, which is partially converted into an amount of solid $CO_2$ in said container, for the purpose of maintaining one or more products, loaded into said container 100, at a defined temperature, below a defined temperature, or within a defined temperature range, which temperature or temperature range is below environmental temperature, said system comprising weighing means for subjecting said container 100 to a weighing operation resulting into a weight of said container.

Moreover, the invention relates to a system for filling a container 100 with an amount of $CO_2$, which is partially converted into an amount of solid $CO_2$ in said container 100, for the purpose of maintaining one or more products, loaded into said container 100, at a defined temperature, below a defined temperature, or within a defined temperature range, which temperature or temperature range is below environmental temperature, said system comprising:

- weighing means 200, capable of determining the weight of said container 100;
- a barcode scanner, capable of scanning a barcode 150, provided with said container 100 for generating barcode data;
- calculating means, capable of calculating the weight of the amount of solid $CO_2$ to be supplied to the container 100, based on said barcode data; and
- filling means 400, capable of filling said container 100 with an amount of liquid $CO_2$ that at least partially converts into solid $CO_2$ into said container 100, thereby monitoring the weight of the container 100, until the weight of the container 100 is equal to the weight of the container previously determined, increased by the weight of the calculated amount of solid $CO_2$; and a database 100, capable of storing said barcode data, and data on the weight of the amount of solid $CO_2$, supplied to said container 100.

The invention further relates to a method of estimating a residence time remaining of solid $CO_2$ in a container 100. A user or recipient (e.g., final recipient such as a customer or intermediate recipient such as a distributor) of the container 100 can receive the container 100 with the solid $CO_2$ contained therein. The container 100 is designed to be capable of receiving and storing one or more products. The products are to be maintained using the solid $CO_2$ at a defined temperature, below a defined temperature, or within a defined temperature range. As used herein and throughout, "defined temperature" or "defined temperature range" is a suitable temperature or temperature range of a container 100 that has a temperature or temperature range below an environmental temperature, in which the defined temperature or defined temperature range is sufficient to maintain preservation for a certain duration of one or more products loaded or to be loaded into the container 100.

A machine-readable optical label such as a barcode 150 or QR code that is included with the container 100 or associated packaging is scanned by a scanner. The machine-readable optical label can be read by a smartphone or another dedicated reader to determine unique identification information of the container 100. The machine-readable optical label is included with the container 100 such that the machine-readable optical label can be located anywhere on the outside or inside of the container 100 or associated packaging.

Alternatively, the container 100 may include a radiofrequency (as used herein, "RF") transmitter, such as a RF tag (e.g., RFID tag), Bluetooth tag or near-field communication (NFC) tag. In one example, the RF transmitter is a NFC tag, which requires close proximity to the NFC reader. In another example, the RF transmitter is a RF tag, which can operate over longer ranges than NFC tags. The exact type of RF tag to use can depend on the specific operational ranges required. The RF transmitter can be read by a RF reader, such as a smartphone, other cloud connected device or a purpose-built, cloud connected RF device to identify the unique identification information of the container 100. "Cloud connected device" such as a "cloud connected RF device" means any digital device that can be used to read data related to the container and then transmit the data to a cloud database, where the data can be stored. Examples include cameras, RF gateways, scales and smartphones. "Cloud database" as used herein is intended to mean a digital repository of information for individual containers that contains specific attributes of the individual containers, in which the digital repository of information can be appended or modified as information related to the individual containers is collected over time. The RF transmitter can relay a RF transmission that is received by the RF reader.

The machine-readable optical label or RF transmitter can be attached to the container 100 or accompanying packaging. Either the scanning of the machine-readable optical label or connecting to the RF transmitter allows the container 100 to be recognized and specifically identified, such that certain application software can be launched upon the scanner or RF reader, respectively, linking to the application software. The application software accesses unique identification information for container 100, preferably through a dedicated secured internet website. The unique identification information of container 100 includes, but is not limited to, a tare weight of the container 100 and a standard sublimation rate associated with the container 100. Generally speaking, the standard sublimation rate defines the expected rate at which the solid $CO_2$ in the container 100 is converting or sublimating into vapor. The standard sublimation rate in one example is determined by a supplier of the container 100 prior to transport of the container 100 filled with solid $CO_2$ to the user or recipient. The unique identification information can be stored on the machine-optical label or the RF transmitter and/or locally or remotely in a database. The database can be, by way of example, maintained and stored in a cloud database. For example, a serial identification number or model number for container 100 may be locally accessed by application software while other unique identification information of container 100 is remotely accessed by application software from a database. The container 100 is placed on the scale after the scale has been tared. A real-time weight of the solid $CO_2$ in the container 100 is determined by subjecting the container 100 to a weighing operation using a scale (e.g., weighing scale 200) resulting in the real-time weight of the container 100.

After identifying the unique container 100, which can be based on unique information retrieved through the machine-readable optical label or RF transmitter, and having subject the container 100 to the weighing operation, the application software determines the remaining residence time for the solid $CO_2$ in the container 100 as follows:

$$D=(W_{(t)}-W_{tare})/R_s$$

where, D (days) is the remaining residence time of the solid $CO_2$ in the container 100, W(t) (lbs) is the real-time weight of the solid $CO_2$ in the container 100 that is being measured at time t by subjecting the container 100 to the weighing operation using the scale, $W_{tare}$ (lbs) is the weight of the container 100 itself and Rs (lbs/day) is the standard sublimation rate of the solid $CO_2$ in the container 100. $W_{tare}$ and $R_s$, both of which form, at least a portion of a particular container's 100 unique identification information, have been previously inputted (i) locally into the machine-optical label, or the RF transmitter or (ii) locally or remotely into a database. In one example, $W_{tare}$ and $R_s$ are inputted by a supplier of the container 100, where the supplier initially introduces solid $CO_2$ into the container 100 until a fill weight, $W_{fill}$, is created therein. It should be noted that $W_{fill}$ has been previously added into a database. The application software can access such unique identification information at (i) or (ii).

It should be understood that the method of the present invention can be utilized by any recipient or user having a need to periodically monitor the remaining residence time of the solid $CO_2$ in the container 100. The monitoring can occur prior to or during transport or upon arrival of the container 100 to a specific destination. The supplier of the container 100 may receive notification when a user or recipient of container 100 has performed a real-time weight measurement.

The real-time weight determination may also occur with one or more products inside of container 100. Alternatively, or in addition thereto, the step of determining the real-time weight of the solid $CO_2$ in the container 100 (W(t)) may include subjecting the container 100 to the weighing operation in a presence of accompanying packaging or accessories using the scale and resulting in the real-time weight of the container 100, products therein, and the accompanying packaging or the accessories. Examples of accessories can include various components of container 100, such as, by way of example, a cap, a temperature monitor or temperature device probe affixed to the container 100 or a sample holder within container 100. Additionally, accessories can include return labelling or other instructions of use provided with container 100. Accompanying packaging can include, but is not limited to, the shipping box (e.g., cardboard box) into which the container 100 is placed during transport. As used herein and throughout, it should be understood that when products or accompanying packaging or accessories are included in the measurement of the real-time weight Wt, the tare weight Wtare includes those same products or accompanying packaging such that the difference Wt−Wtare yields the weight of the solid $CO_2$ dry ice in the container at time t. Preferably, the supplier of the container 100 receives notification when a user or recipient of container 100 has performed a real-time weight measurement with one or more products loaded into container 100.

Any suitable device may be utilized for hosting the application software such as by way of example, a smart phone, smart scale, dedicated scanner, RF reader (examples of which have been provided hereinbefore) or computer terminal. The device is in a wired or wireless communication with a network and a server. Alternatively, the application software can be located on the scale that is used to perform the real-time weight measurement of the solid $CO_2$ in the container 100 that is being measured at time t.

The inventive method in another aspect includes an automatic notification system that is configured to send one or more notification alerts to one or more users or recipients when certain conditions are triggered. For example, an alert can be transmitted when the measured real-time weight of the solid $CO_2$ is greater than the fill weight of the solid $CO_2$. Such a notification alert that the real-time weight is greater than the fill weight can indicate a potential operational or system error has occurred (e.g., the weight measurement has been performed incorrectly). The notification alert can be transmitted to one or more recipients of container 100 to repeat the weight measurement to eliminate the potential of an operational error where, by way of example, the weight measurement has been performed incorrectly. The term 'fill weight' of the solid $CO_2$ as used herein is defined as the weight of the solid $CO_2$ after the most recent filling of the container 100 with an initial amount of the solid $CO_2$. Preferably, the fill weight is a value that is previously determined by a provider of the container 100 (e.g., by a supplier of the container 100 that has preferably also filled the container 100 with the solid $CO_2$) and stored in a local or remote database accessible by the application software.

Another type of notification alert can be generated when the calculated remaining residence time of the solid $CO_2$ is less than a specified critical limit. For example, a notification alert can be transmitted to a user or recipient of the container 100 when the remaining residence time of the solid $CO_2$ in the container 100 is less than one (1) day. In such an instance, the notification alert is a message that instructs the user or recipient of container 100 to return the container 100 to the supplier as a result of the remaining residence time determined to be insufficient for further use (e.g., insufficient for the preservation of one or more products loaded or to be loaded into container 100 at or below a certain defined temperature or within a defined temperature range). Alternatively, or in addition thereto, the conditions under which return of the container 100 should occur can be provided as instructions of use, which may be included with the container 100 and associated packaging.

A notification alert can also be generated when the actual sublimation rate, Ra, is outside a specified tolerance of the standard sublimation rate, Rs, where Ra can be determined as follows:

$$R_a=(W_{fill}-W(t))/(T(t)-T_{fill})$$

where, Ra is the actual sublimation rate (lbs/day); $W_{fill}$ is the weight of the container 100 after the most recent filling of the container 100 with an initial amount of the solid $CO_2$ occurring at an initial time $T_{fill}$, and W(t) is the real-time weight of the container 100 that is being measured at time T(t) by subjecting the container 100 to the weighing operation using the scale. $W_{fill}$ and $T_{fill}$ are preferably values stored in a database that is accessible locally or remotely by the application software. It should be understood, that the same weight of product and/or accompanying packaging or accessories should be included in $W_{fill}$ and W(t) such that the difference $W_{fill}$−W(t) yields an accurate measurement of the amount of solid $CO_2$ that has sublimated over the time interval T(t)−$T_{fill}$. A value of Ra greater than a value of Rs can indicate a container 100 that has structurally degraded and the expected solid $CO_2$ residence time might not be achieved.

In yet another embodiment of the present invention, a method of preparing a container 100 with solid $CO_2$ introduced inside the container 100 is provided. The container 100 is configured to contain one or more products; and the products are to be maintained using the solid $CO_2$ at a defined temperature, below a defined temperature, or within a defined temperature range, the defined temperature or the defined temperature range being below an environmental temperature, in which the defined temperature or the defined temperature range is sufficient to maintain preservation for a certain duration of one or more products loaded or to be loaded into container 100. The method is capable of providing an estimate of residence time of the solid $CO_2$ remaining in the container 100 on a real-time basis. A standard sublimation rate, $R_s$, (lbs/day) of a container 100 and a tare weight, $W_{tare}$ (lbs), is determined. Next, solid $CO_2$ is filled into an inner part of the container 100 until a fill weight of the solid $CO_2$ is generated inside the container 100. It should be understood that solid $CO_2$ may be filled into the container 100 in any manner, including by transferring solid $CO_2$ in the form of pellets, nuggets, flakes or slab of dry ice, as well as charging liquid $CO_2$ from a liquid $CO_2$ source into the container 100 such that at least a portion of the liquid $CO_2$ is converted into solid $CO_2$.

A machine-readable optical label or RF transmitter can be affixed to or included with the container 100 or associated packaging. For example, a machine-readable optical label or RF transmitter can be included with the container 100 such that the machine-readable optical label or RF transmitter can be located anywhere on the outside or inside of the container 100 or associated packaging. Unique identifier information of the container 100 is inputted into a database or into the machine-readable optical label or into a RF transmitter. The unique identifier information of the container 100 comprises, but is not limited to, a standard sublimation rate of the solid $CO_2$ in the container 100, a tare weight of the container 100 and a fill weight of the container 100, all of which can be accessed by application software upon scanning the machine-readable optical label or connecting to the RF transmitter. Other types of unique identifier information may be included, such as by way of example, the manufacturing date of the container 100 and a model number of the container 100. The application software is configured to calculate the residence time of the solid $CO_2$ in the container 100 based on the tare weight, the fill weight and the standard sublimation rate. The application software is also configured to calculate the remaining residence time based on the tare weight, the standard sublimation rate and the weight of the solid $CO_2$ remaining in the container 100 that is measured subsequent to the fill weight. It should be understood that the step of measuring the weight of the solid $CO_2$ filled into the container 100 or solid $CO_2$ remaining in the container 100 can be performed in the presence of accompanying packaging or accessories as previously described herein.

Having prepared the container 100 with solid $CO_2$ introduced (e.g., loaded or charged) inside the container 100, certain arrangements can made for delivering the container 100 to an intermediate and/or final destination site. In one example, the container 100 with solid $CO_2$ filled therein is transported by a commercial carrier such as United Parcel Service (UPS) or Federal Express (FedEx) to the intermediate or final destination site for access or use by a corresponding intermediate recipient or final recipient. Additionally, instructions for use and instructions for handling of the container 100 can also accompany the container 100 during transport.

The step of preparing the container 100 can include assigning an alphanumeric identification (ID) number for the container 100. The ID number can be stored and maintained on a machine-readable optical label or RF transmitter and/or locally or remotely in a database that is accessible by the application software. The ID is one of the pieces of information that is considered part of the unique identifier information of a container 100. In one example, the ID is a serial number. The database contains historical information of the container 100, including weight measurements of the container 100 and the time, location and dates when such weight measurements were performed, along with identification of the type of weight measurement. The type of weight measurement can be a (i) tare weight of container 100, (ii) a fill weight of container 100, or (iii) a real-time weight of the container 100 that is being measured subsequent to the fill weight at time t by subjecting the container 100 to a weighing operation using a scale. The historical information of the container 100 can include measurements performed by suppliers, users and recipients of the container 100. The historical information is preferably accessible by the supplier of the container 100, but also may be accessible by the recipients and users of the container 100.

As part of the preparation of container 100, an actual sublimation rate of the container 100, Ra (lbs/day) can be determined as previously described herein. The actual sublimation rate can be compared with a standard sublimation rate, Rs, as previously described herein, with certain notification alerts generated should the Ra exceed a specified tolerance of the Rs.

Other methods for identification of the unique identification information of the container 100 by the application software are contemplated. For example, digital image processing techniques can be employed to carry out the present invention. In one example of a digital image processing technique, a dedicated cloud connected device, such as a smartphone camera, can be utilized to identify the unique identification information. The identification is based on algorithms typically used in applications such as facial recognition, whereby the algorithms recognize and read certain text, numbers and various types of graphics. In particular, the camera-based technique which can be used in the present invention reads a unique alphanumeric or pictographic label on the container 100 or accompanying packaging as the means for identifying the unique identification information.

The present invention contemplates various ways for identifying a container. For instance, the identification process can be performed manually. An example of a manual identification process of a container involves a user using a smartphone to read a barcode. A cellular connection links unique identification information of the container to a cloud database. The identification process can also be done by an automatic process without user intervention. An example of an automated process involves a cloud connected RF scanning device identifying a container that is in close proximity through a RF transmitter on the container. Upon identifying the container, a cloud database is linked to by the RF scanning device or information relating to the container is uploaded into the cloud database by the RF scanning device.

It should be understood that the principles of the present invention are applicable for estimating a residence time remaining of other refrigerants in a container. For example, a recipient (e.g., intermediate or final) can receive the container with refrigerant. The container is configured to contain one or more products; and the products are to be maintained using the refrigerant at a defined temperature, below a defined temperature, or within a defined temperature range, the defined temperature or the defined temperature range being below an environmental temperature, in which the defined temperature or defined temperature range is sufficient to maintain preservation for a certain duration of the one or more products loaded or to be loaded into container. A machine-readable optical label is scanned or a RF transmission from a RF transmitter included with the container is received to enable launching of application software as a result of the application software linking to the unique identifier information of the container 100. The machine-readable optical label and RF transmitter as included with the container can be located anywhere on the outside or inside of the container and associated packaging. The application software accesses unique identification information for the container from the machine-readable optical label or the RF transmitter. The unique identification information resides locally on the machine-readable optical label or the RF transmitter or remotely on a database. The unique identifier information includes a tare weight of the container and a standard refrigerant evaporation rate associated with the container. A real-time weight of the container is determined by subjecting the container to a weighing operation using a scale, resulting in the real-time weight of the container. The residence time remaining is determined such that the one or more products can be maintained at the defined temperature, below the defined temperature, or within the defined temperature range.

In another embodiment, a method of preparing the container with refrigerant introduced inside the container is provided. The container is adapted to provide an estimate of a residence time of the refrigerant remaining in the container on a real-time basis. A standard refrigerant evaporation rate associated with the container is determined. A tare weight of the container is also determined.

An inner part of the container is filled with the refrigerant until a desired fill weight of the refrigerant is generated inside the container. A machine-readable optical label or RF transmitter is affixed to or included within the container, such that the machine-readable optical label or RF transmitter can be located anywhere along the outside or inside of the container and associated packaging. Unique identifier information of the container is inputted into a database, the machine-readable optical label or the RF transmitter or a combination thereof. The unique identifier information of the container includes, but is not limited to, the standard evaporation rate, the tare weight of the container and the fill weight of the container, all of which can be accessed by application software upon scanning the machine-readable optical label or connecting to the RF transmitter. The application software is configured to calculate the residence time of the refrigerant in the container based on the tare weight, the fill weight, and the standard refrigerant evaporation rate. The application software is also configured to calculate the remaining residence time based on the tare weight, the standard refrigerant evaporation rate and the weight of the refrigerant remaining in the container that is measured subsequent to the fill weight. It should be understood that the step of measuring the weight of the refrigerant filled into container or refrigerant remaining in the container can be performed in the presence of accompanying packaging or accessories as previously described herein.

In one example, the refrigerant is liquid nitrogen absorbed onto an absorbent. In another example, the refrigerant is helium.

The methods of the present invention allow for real-time assessment of the functional performance of the container. By (i) estimating Ra or an actual evaporation rate, (ii) comparing the Ra or actual evaporation rate of refrigerant with the Rs or standard evaporation rate of refrigerant, and then (iii) determining the Ra or the actual evaporation rate of the refrigerant to be unacceptably higher than the Rs or standard evaporation rate of the refrigerant, the present invention allows for detection of containers that may have structurally degraded and as a result should be removed from operational service; such real-time detection and notification is a benefit not previously provided by containers filled with solid $CO_2$ or other refrigerants. Additionally, the ability of the present invention to assess on a real time basis the estimated remaining residence time of the solid $CO_2$ or other refrigerant in the container allows for a more efficient use and management of a fleet of the containers filled with solid $CO_2$ or other refrigerant, whereby decisions on where to transport the containers can be made by anyone in the supply chain from supplier to final user or recipient, as a result of timely notification alerts provided based on real-time weight measurements of the container being performed. In one example, when the refrigerant is solid $CO_2$, and the Ra is determined to fall within an acceptable tolerance of the Rs, containers with less than one (1) day of residence time remaining of the solid $CO_2$ in the container are recommended by the application software to be returned to the supplier, whereas containers with greater than one (1) day of residence time remaining of the solid $CO_2$ in the container are deemed functionable (i.e., configured to contain one or more products, wherein the products are to be maintained using the solid $CO_2$ at a defined temperature, below a defined temperature, or within a defined temperature range, the defined temperature or the defined temperature range being below an environmental temperature, in which the defined temperature or defined temperature range is sufficient to maintain preservation for a certain duration of the one or more products loaded or to be loaded into a container).

The invention claimed is:

1. A method for estimating a remaining residence time of solid $CO_2$ in a container, the method comprising:

receiving the container with the solid $CO_2$, wherein the container is configured to contain one or more products different from $CO_2$; and wherein the one or more products are maintained at a defined temperature, below a defined temperature, or within a defined temperature range, using the solid $CO_2$, the defined temperature or the defined temperature range being below an environmental temperature;

scanning a machine-readable optical label or connecting to a radiofrequency (RF) transmitter, the machine-readable optical label or the RF transmitter being affixed to or included with the container or accompanying packaging;

launching application software;

accessing unique identification information for the container from the machine-readable optical label or the RF transmitter, the unique identification information residing locally on the machine-readable optical label or the RF transmitter; or residing locally or remotely in a database or a combination thereof, the unique identification information including a tare weight of the container and a standard sublimation rate associated with the container;

determining a real-time weight of the solid $CO_2$ in the container by subjecting the container to a weighing operation using a scale resulting in a real-time weight of the container; and calculating the remaining residence time of the solid $CO_2$, such that the one or more products can be maintained at the defined temperature, below the defined temperature, or within the defined temperature range, wherein the remaining residence time of the solid $CO_2$ is based, at least in part, on the real-time weight of the solid $CO_2$ in the container and the standard sublimation rate.

2. The method according to claim 1, wherein the determining the real-time weight of the solid $CO_2$ in the container includes subjecting the container to the weighing operation in a presence of the accompanying packaging or accessories using the scale and resulting in the real-time weight of the container and the accompanying packaging or the accessories.

3. The method according to claim 1, further comprising confirming: (i) the scale is tared; and (ii) the container is placed on the scale.

4. The method according to claim 1, further comprising sending an alert when the real-time weight of the container is greater than a fill weight of the container, the fill weight of the container being defined as a weight of the container after a most recent filling of the container with an initial amount of the solid $CO_2$, and the fill weight of the container being previously obtained and stored in a database of the application software.

5. The method according to claim 1, wherein the container is loaded with the one or more products.

6. The method according to claim 1, wherein the launching the application software includes hosting the application software on a device.

7. The method according to claim 6, wherein the device is in wired or wireless communication with a network and a server.

8. The method according to claim 1, further comprising generating a notification alert when the remaining residence time of the solid $CO_2$ which has been calculated is less than a specified critical limit, the notification alert instructing return of the container to a supplier of the container.

9. The method according to claim 1, further comprising determining an actual sublimation rate as $R_a=(W_{fill}-W(t))/(T(t)-T_{fill})$, wherein:

Ra is the actual sublimation rate;

$W_{fill}$ is a fill weight of the container which is defined as a weight of the container after a most recent filling of the container with an initial amount of the solid $CO_2$ occurring at an initial time $T_{fill}$;

W(t) is the real-time weight of the container that is measured at time T(t); and the fill weight of the container is previously obtained and stored in a database of the application software.

10. The method according to claim 9, further comprising generating a notification alert when the actual sublimation rate is outside a specified tolerance of the standard sublimation rate.

11. The method according to claim 1, wherein data for the real-time weight of the solid $CO_2$ in the container is stored in a database of the application software.

* * * * *